US009677384B2

(12) United States Patent
Delgado

(10) Patent No.: US 9,677,384 B2
(45) Date of Patent: Jun. 13, 2017

(54) DOWNHOLE ACTIVELY CONTROLLED POWER GENERATION MECHANISM

(71) Applicant: Schlumberger Technology Corporation, Sugar Land, TX (US)

(72) Inventor: Miguel Marcel Jose Delgado, Bristol (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 367 days.

(21) Appl. No.: 14/337,058

(22) Filed: Jul. 21, 2014

(65) Prior Publication Data

US 2016/0017695 A1 Jan. 21, 2016

(51) Int. Cl.
*E21B 4/02* (2006.01)
*E21B 41/00* (2006.01)

(52) U.S. Cl.
CPC ..... *E21B 41/0085* (2013.01); *E21B 4/02* (2013.01)

(58) Field of Classification Search
CPC ..... E21B 41/0085; E21B 4/006; E21B 4/02; E21B 47/182; E21B 4/00
See application file for complete search history.

(56) References Cited

U.S. PATENT DOCUMENTS 3,319,419 A 5/1967 Hann
3,792,428 A * 2/1974 Harrell ..... E21B 3/00 200/61.46
3,828,618 A 8/1974 Sharpe et al.
3,932,836 A * 1/1976 Harrell ..... B06B 1/04 175/40
4,609,842 A 9/1986 Aleem et al.
4,678,045 A 7/1987 Lyons
5,517,464 A 5/1996 Lerner et al.
6,092,610 A 7/2000 Kosmala et al.
7,434,634 B1 10/2008 Hall et al.
2004/0262043 A1* 12/2004 Schuaf ..... E21B 3/02 175/57

(Continued)

FOREIGN PATENT DOCUMENTS

EP 1054193 11/2000

OTHER PUBLICATIONS

International Search Report and Written Opinion issued in related International Application No. PCT/US2015/041052 mailed Oct. 27, 2015 (12 pages).

*Primary Examiner* — Daniel P Stephenson

(57) ABSTRACT

Aspects of the disclosure can relate to a system that includes an input shaft to be driven by a variable fluid flow, and an output shaft coupled with the input shaft to drive a generator. The generator can be an alternator, and the input shaft can be coupled with a turbine to be driven by drilling fluid or another fluid. The system also includes a drive mechanism mechanically coupling the input shaft to the output shaft to drive the generator at a predetermined rotational speed. The system further includes a secondary input mechanically coupled with the drive mechanism, where the secondary input is driven at a variable input speed to drive the generator at the predetermined rotational speed. The drive mechanism can be a full freedom epicycloids gear train, and the secondary input can be a speed correction motor, a mechanical actuator driven by variable fluid flow, and so forth.

9 Claims, 7 Drawing Sheets

(56) References Cited

U.S. PATENT DOCUMENTS

| | | | | |
|---|---|---|---|---|
| 2007/0125578 | A1 | 6/2007 | McDonald et al. | |
| 2010/0101781 | A1* | 4/2010 | Scholz | E21B 4/006 166/244.1 |
| 2010/0230966 | A1* | 9/2010 | Pavlak | F03D 9/002 290/44 |
| 2013/0328316 | A1* | 12/2013 | Rodney | E21B 41/0085 290/54 |
| 2016/0017659 | A1 | 1/2016 | Delgado et al. | |
| 2016/0017693 | A1* | 1/2016 | Winslow | E21B 41/0085 175/95 |
| 2016/0017695 | A1* | 1/2016 | Delgado | E21B 4/02 175/57 |
| 2016/0053589 | A1* | 2/2016 | Delgado | E21B 41/0085 166/65.1 |
| 2016/0084043 | A1* | 3/2016 | Cobb | E21B 41/0085 166/244.1 |
| 2016/0145975 | A1* | 5/2016 | Carroll | E21B 41/0085 166/244.1 |

* cited by examiner

DOWNHOLE ACTIVELY CONTROLLED POWER GENERATION MECHANISM

BACKGROUND

Oil wells are created by drilling a hole into the earth using a drilling rig that rotates a drill string (e.g., drill pipe) having a drill bit attached thereto. The drill bit, aided by the weight of pipes (e.g., drill collars) cuts into rock within the earth. Drilling fluid (e.g., mud) is pumped into the drill pipe and exits at the drill bit. The drilling fluid may be used to cool the bit, lift rock cuttings to the surface, at least partially prevent destabilization of the rock in the wellbore, and/or at least partially overcome the pressure of fluids inside the rock so that the fluids do not enter the wellbore.

SUMMARY

Aspects of the disclosure can relate to a down hole drill assembly that includes an input shaft to be driven by a variable fluid flow, and an output shaft coupled with the input shaft to drive an alternator. The input shaft can be coupled with a turbine to be driven by drilling fluid or another fluid. The down hole drill assembly also includes a drive mechanism mechanically coupling the input shaft to the output shaft to drive the alternator at a predetermined rotational speed. The down hole drill assembly further includes a secondary input mechanically coupled with the drive mechanism, where the secondary input is driven at a variable input speed to drive the alternator at the predetermined rotational speed.

Other aspects of the disclosure can relate to a method that includes driving an input shaft coupled with a turbine with a variable fluid flow of drilling fluid or another fluid. The method also includes driving an alternator with an output shaft coupled with the input shaft. The method further includes mechanically coupling the input shaft to the output shaft with a drive mechanism to drive the alternator at a predetermined rotational speed, and mechanically coupling a secondary input with the drive mechanism. The method also includes driving the secondary input at a variable input speed to drive the alternator at the predetermined rotational speed.

Also, aspects of the disclosure can relate to a system that includes an input shaft to be driven by a variable fluid flow, and an output shaft coupled with the input shaft to drive a generator. The system also includes a drive mechanism mechanically coupling the input shaft to the output shaft to drive the generator at a predetermined rotational speed. The system further includes a secondary input mechanically coupled with the drive mechanism, where the secondary input is driven at a variable input speed to drive the generator at the predetermined rotational speed.

This summary is provided to introduce a selection of concepts that are further described below in the detailed description. This summary is not intended to identify key or essential features of the claimed subject matter, nor is it intended to be used as an aid in limiting the scope of the claimed subject matter.

FIGURES

Embodiments of a down hole actively controlled power generation mechanism are described with reference to the following figures. The same numbers are used throughout the figures to reference like features and components.

DETAILED DESCRIPTION

Figure 1:
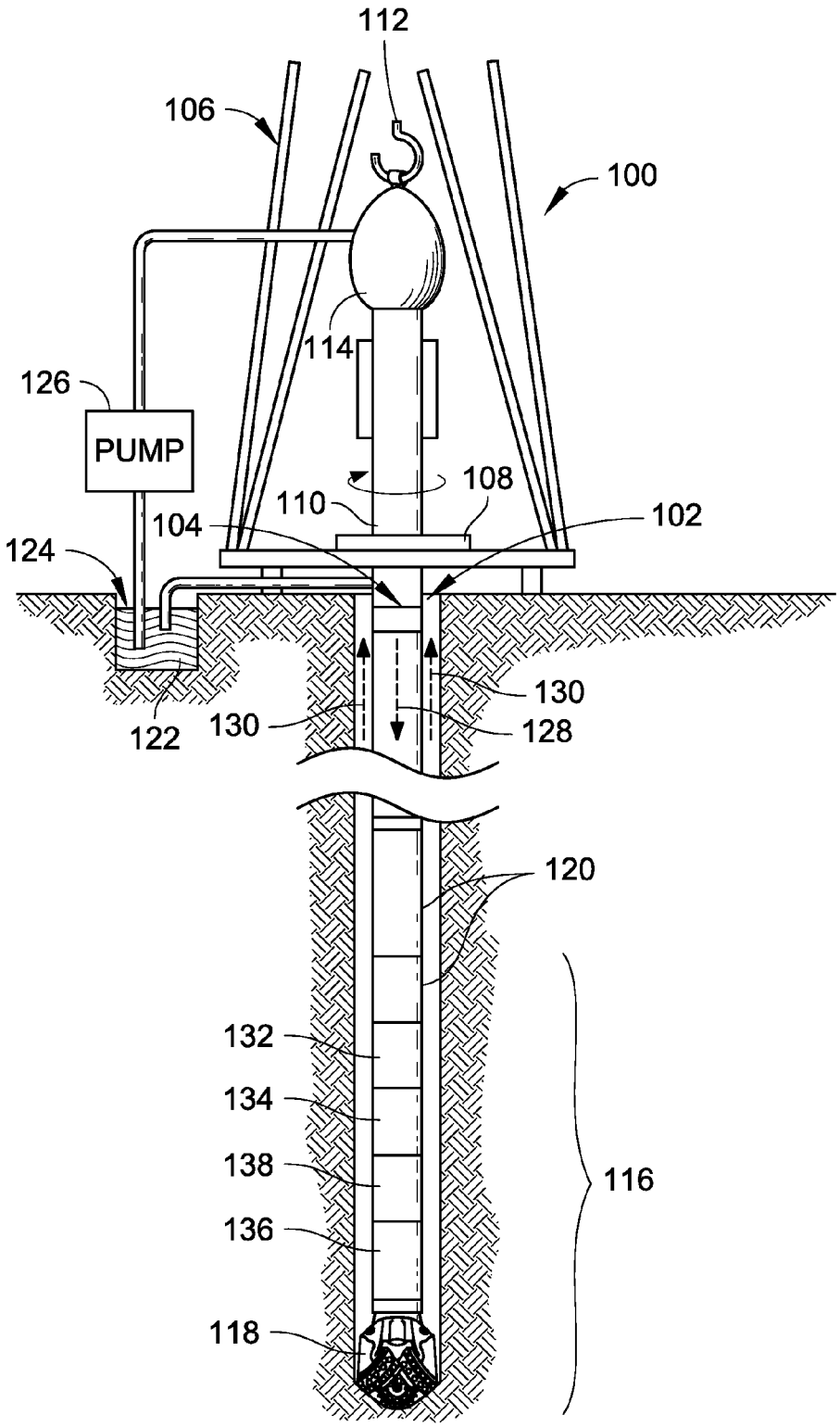
FIG. 1 illustrates an example system in which embodiments of a down hole actively controlled power generation mechanism can be implemented.
Figure 2:
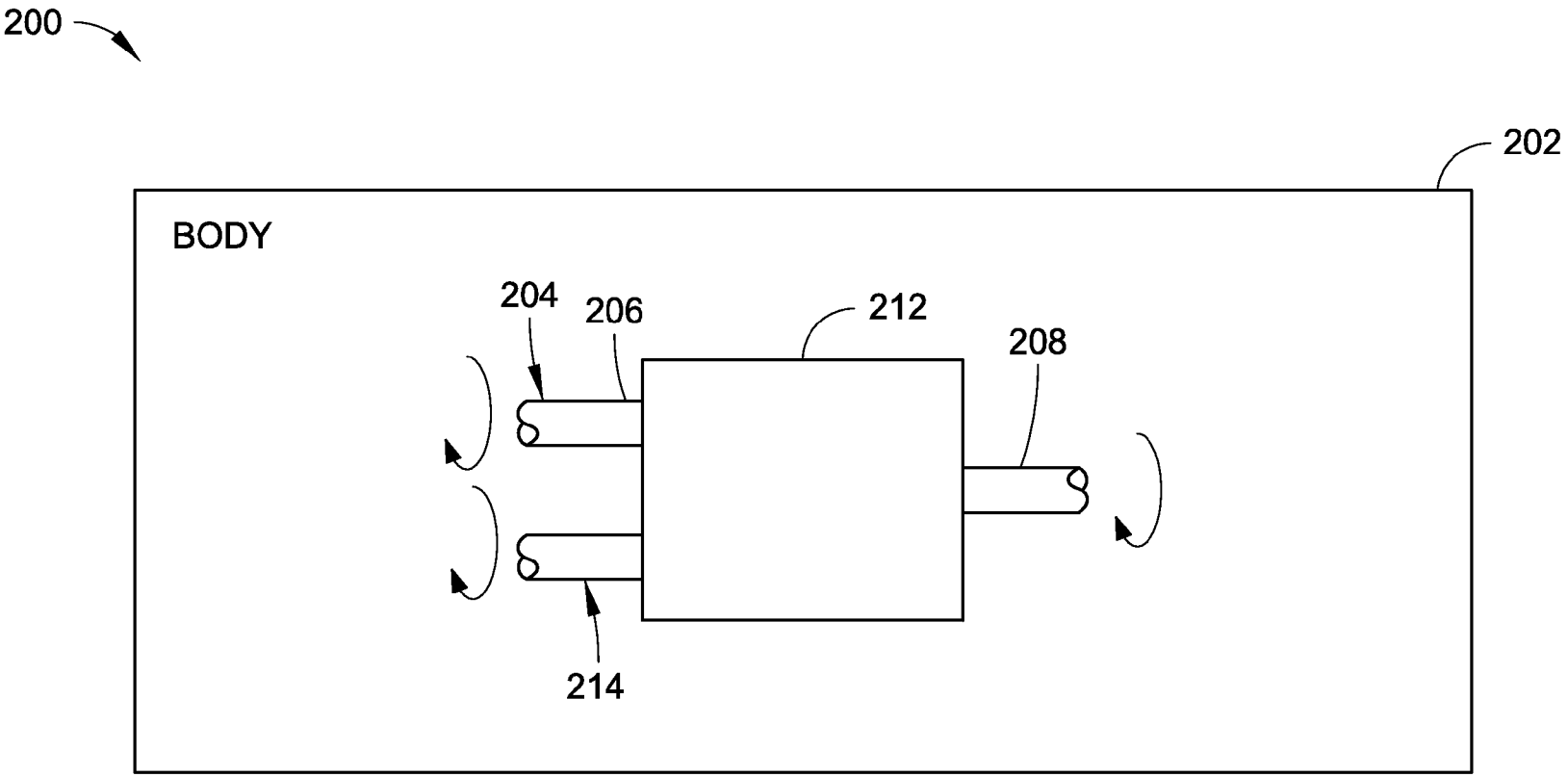
FIG. 2 illustrates various components of an example device that can implement embodiments of a down hole actively controlled power generation mechanism.

FIG. 1 depicts a wellsite system 100 in accordance with one or more embodiments of the present disclosure. The wellsite can be onshore or offshore. A borehole 102 is formed in subsurface formations by directional drilling. A drill string 104 extends from a drill rig 106 and is suspended within the borehole 102. In some embodiments, the wellsite system 100 implements directional drilling using a rotary steerable system (RSS). For instance, the drill string 104 is rotated from the surface, and down hole devices move the end of the drill string 104 in a desired direction. The drill rig 106 includes a platform and derrick assembly positioned over the borehole 102. In some embodiments, the drill rig 106 includes a rotary table 108, kelly 110, hook 112, rotary swivel 114, and so forth. For example, the drill string 104 is rotated by the rotary table 108, which engages the kelly 110 at the upper end of the drill string 104. The drill string 104 is suspended from the hook 112 using the rotary swivel 114, which permits rotation of the drill string 104 relative to the hook 112. However, this configuration is provided by way of example and is not meant to limit the present disclosure. For instance, in other embodiments a top drive system is used.

A bottom hole assembly (BHA) 116 is suspended at the end of the drill string 104. The bottom hole assembly 116 includes a drill bit 118 at its lower end. In embodiments of the disclosure, the drill string 104 includes a number of drill pipes 120 that extend the bottom hole assembly 116 and the drill bit 118 into subterranean formations. Drilling fluid (e.g., mud) 122 is stored in a tank and/or a pit 124 formed at the wellsite. The drilling fluid can be water-based, oil-based, and so on. A pump 126 displaces the drilling fluid 122 to an interior passage of the drill string 104 via, for example, a port in the rotary swivel 114, causing the drilling fluid 122 to flow downwardly through the drill string 104 as indicated by directional arrow 128. The drilling fluid 122 exits the drill string 104 via ports (e.g., courses, nozzles) in the drill bit 118, and then circulates upwardly through the annulus region between the outside of the drill string 104 and the wall of the borehole 102, as indicated by directional arrows 130. In this manner, the drilling fluid 122 cools and lubricates the drill bit 118 and carries drill cuttings generated by the drill bit 118 up to the surface (e.g., as the drilling fluid 122 is returned to the pit 124 for recirculation).

In some embodiments, the bottom hole assembly 116 includes a logging-while-drilling (LWD) module 132, a measuring-while-drilling (MWD) module 134, a rotary steerable system 136, a motor, and so forth (e.g., in addition to the drill bit 118). The logging-while-drilling module 132 can be housed in a drill collar and can contain one or a number of logging tools. It should also be noted that more than one LWD module and/or MWD module can be employed (e.g. as represented by another logging-while-drilling module 138). In embodiments of the disclosure, the logging-while drilling modules 132 and/or 138 include capabilities for measuring, processing, and storing information, as well as for communicating with surface equipment, and so forth.

The measuring-while-drilling module 134 can also be housed in a drill collar, and can contain one or more devices for measuring characteristics of the drill string 104 and drill bit 118. The measuring-while-drilling module 134 can also include components for generating electrical power for the down hole equipment. This can include a mud turbine generator (also referred to as a "mud motor") powered by the flow of the drilling fluid 122. However, this configuration is provided by way of example and is not meant to limit the present disclosure. In other embodiments, other power and/or battery systems can be employed. The measuring-while-drilling module 134 can include one or more of the following measuring devices: a weight-on-bit measuring device, a torque measuring device, a vibration measuring device, a shock measuring device, a stick slip measuring device, a direction measuring device, an inclination measuring device, and so on.

In embodiments of the disclosure, the wellsite system 100 is used with controlled steering or directional drilling. For example, the rotary steerable system 136 is used for directional drilling. As used herein, the term "directional drilling" describes intentional deviation of the wellbore from the path it would naturally take. Thus, directional drilling refers to steering the drill string 104 so that it travels in a desired direction. In some embodiments, directional drilling is used for offshore drilling (e.g., where multiple wells are drilled from a single platform). In other embodiments, directional drilling enables horizontal drilling through a reservoir, which enables a longer length of the wellbore to traverse the reservoir, increasing the production rate from the well. Further, directional drilling may be used in vertical drilling operations. For example, the drill bit 118 may veer off of a planned drilling trajectory because of the unpredictable nature of the formations being penetrated or the varying forces that the drill bit 118 experiences. When such deviation occurs, the wellsite system 100 may be used to guide the drill bit 118 back on course.

FIGS. 2 through 6 depict drill assemblies 200 that can be used with, for example, a wellsite system (e.g., the wellsite system 100 described with reference to FIG. 1). For instance, the drill assembly 200 can comprise a bottom hole assembly suspended at the end of a drill string (e.g., in the manner of the bottom hole assembly 116 suspended from the drill string 104 depicted in FIG. 1). In some embodiments, a drill assembly 200 is implemented using a drill bit. However, this configuration is provided by way of example and is not meant to limit the present disclosure. In other embodiments, different working implement configurations are used. Further, use of drill assemblies 200 in accordance with the present disclosure is not limited to wellsite systems described herein. Drill assemblies 200 can be used in other various cutting and/or crushing applications, including earth boring applications employing rock scraping, crushing, cutting, and so forth.

The drill assembly 200 includes a body 202 for receiving a flow of drilling fluid. The body 202 comprises one or more crushing and/or cutting implements, such as conical cutters and/or bit cones having spiked teeth (e.g., in the manner of a roller-cone bit). In this configuration, as the drill string is rotated, the bit cones roll along the bottom of the borehole in a circular motion. As they roll, new teeth come in contact with the bottom of the borehole, crushing the rock immediately below and around the bit tooth. As the cone continues to roll, the tooth then lifts off the bottom of the hole and a high-velocity drilling fluid jet strikes the crushed rock chips to remove them from the bottom of the borehole and up the annulus. As this occurs, another tooth makes contact with the bottom of the borehole and creates new rock chips. In this manner, the process of chipping the rock and removing the small rock chips with the fluid jets is continuous. The teeth intermesh on the cones, which helps clean the cones and enables larger teeth to be used. A drill assembly 200 comprising a conical cutter can be implemented as a steel milled-tooth bit, a carbide insert bit, and so forth. However, roller-cone bits are provided by way of example and are not meant to limit the present disclosure. In other embodiments, a drill assembly 200 is configured differently. For example, the body 202 of the bit comprises one or more polycrystalline diamond compact (PDC) cutters that shear rock with a continuous scraping motion.

In embodiments of the disclosure, the body 202 of the drill assembly 200 can define one or more nozzles that allow the drilling fluid to exit the body 202 (e.g., proximate to the crushing and/or cutting implements). The nozzles allow drilling fluid pumped through, for example, a drill string to exit the body 202. For example, as discussed with reference to FIG. 1, drilling fluid 122 is furnished to an interior passage of drill string 104 by pump 126 and flows downwardly through drill string 104 to drill bit 118 of bottom hole assembly 116, which can be implemented using a drill assembly 200. Drilling fluid 122 then exits drill string 104 via nozzles in drill bit 118, and circulates upwardly through the annulus region between the outside of drill string 104 and the wall of borehole 102. In this manner, rock cuttings can be lifted to the surface, destabilization of the rock in the wellbore can be at least partially prevented, the pressure of fluids inside the rock can be at least partially overcome so that the fluids do not enter the wellbore, and so forth.

The body 202 houses components for generating electrical power for the down hole equipment. For example, the body 202 houses a mud turbine 204 powered by the flow of the drilling fluid 122. The mud turbine 204 comprises an input shaft 206, which is configured to be driven by a variable fluid flow, such as the fluid flow of the drilling fluid 122 or another fluid. The drill assembly 200 also includes an output shaft 208 coupled with the input shaft 206 to drive a generator (e.g., an alternator 210). Further, the drill assembly 200 includes a drive mechanism 212 mechanically coupling the input shaft 206 to the output shaft 208. In embodiments of the disclosure, the drill assembly 200 is configured so that the drive mechanism 212 is operable to drive the alternator 210 at a predetermined rotational speed.

Down hole power generation equipment can use an alternator with a permanent magnet motor to provide high power density in a small package. However, the electrical power generated by such alternators may be directly linked to the rotational speed of the rotor in the permanent magnet motor. This can make it difficult to maintain the voltage supplied by the alternator in a desired range. For this reason, complex control systems (e.g., employing hybrid homopolar alternators) and/or mechanically complex and/or less efficient components (e.g., components providing limited flow range, separate turbine flow kits for different flow ranges, and so forth) are often used for down hole power generation. The drill assemblies and techniques described herein can produce electrical power at high densities and stable voltages substantially independently of fluid flow. Further, the drill assemblies and techniques described herein can employ limited control systems (e.g., with respect to more complicated control systems previously described).

In some embodiments, the drive mechanism 212 comprises a constant speed drive (CSD) that mechanically couples the input shaft 206 to the output shaft 208 and operates to drive the alternator 210 at a predetermined rotational speed. In this manner, the input shaft 206 of the mud turbine 204 is not directly actuating the rotor of the alternator 210. Instead, the mechanical drive mechanism 212 modifies the rotation speed of the alternator rotor using a secondary input 214 (e.g., an electric motor, a hydraulic motor, and so on). The secondary input 214 is mechanically coupled with the drive mechanism 212 and can be driven at a variable input speed (e.g., to drive the alternator 210 at a predetermined rotational speed). In some embodiments, a secondary actuation mechanism can be driven by a control system. In other embodiments, the secondary actuation mechanism is not necessarily driven by a control system. As described herein, the rotor speed of the alternator 210 is modified so that the voltage output of the alternator 210 can remain in its operating range at various impeller rotation speeds. This may reduce or eliminate the use of different flow kits for different flow ranges, simplify power supply design, and so on. Further, because the drill assemblies and techniques described herein are not necessarily based upon energy deletion, limited heat losses and/or limited erosion on moving parts and/or flow parts can be achieved (e.g., using the operating principles described herein based upon energy conversion from speed to torque and/or from torque to speed).

Figure 3:
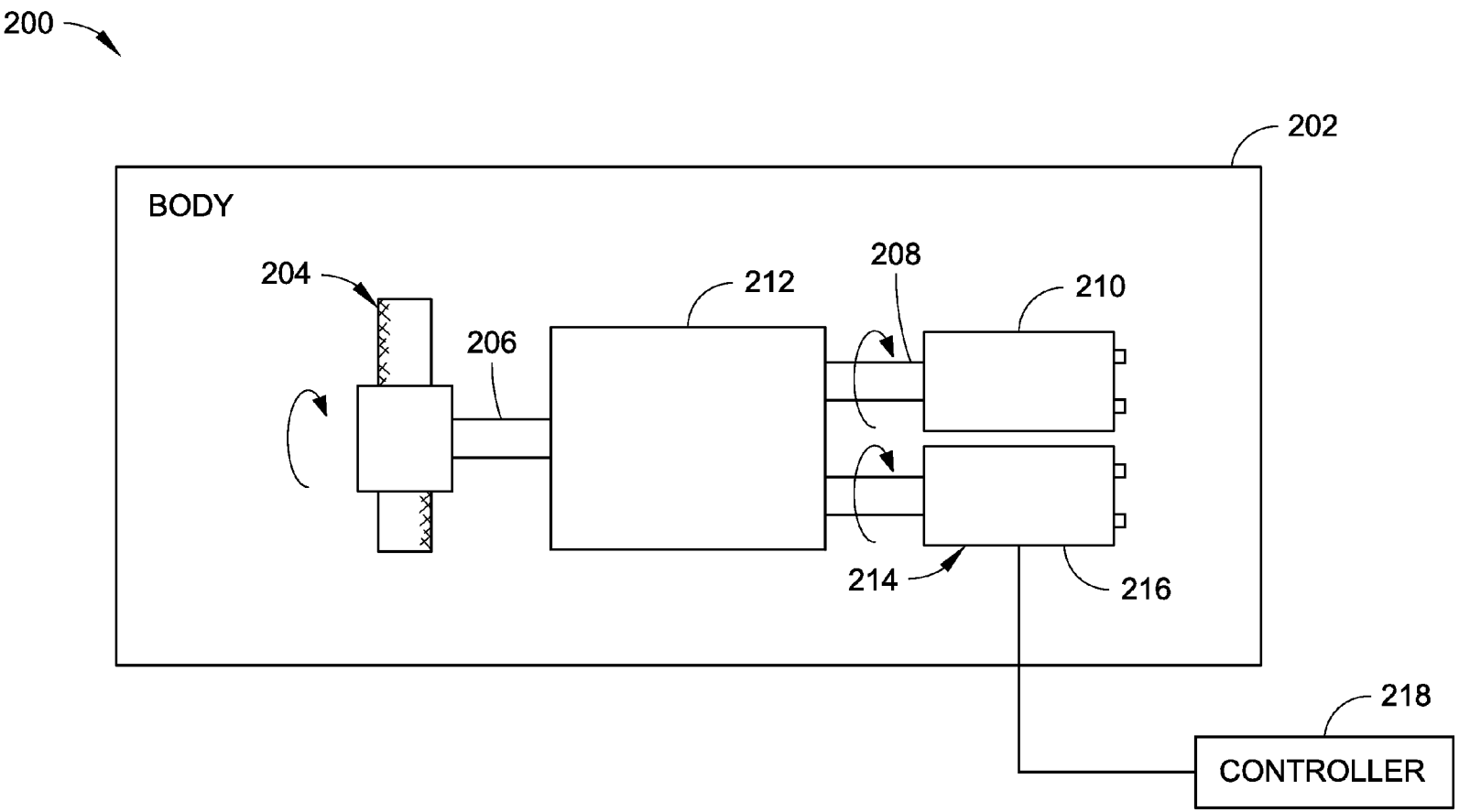
FIG. 3 illustrates various components of an example device that can implement embodiments of a down hole actively controlled power generation mechanism.
Figure 4:
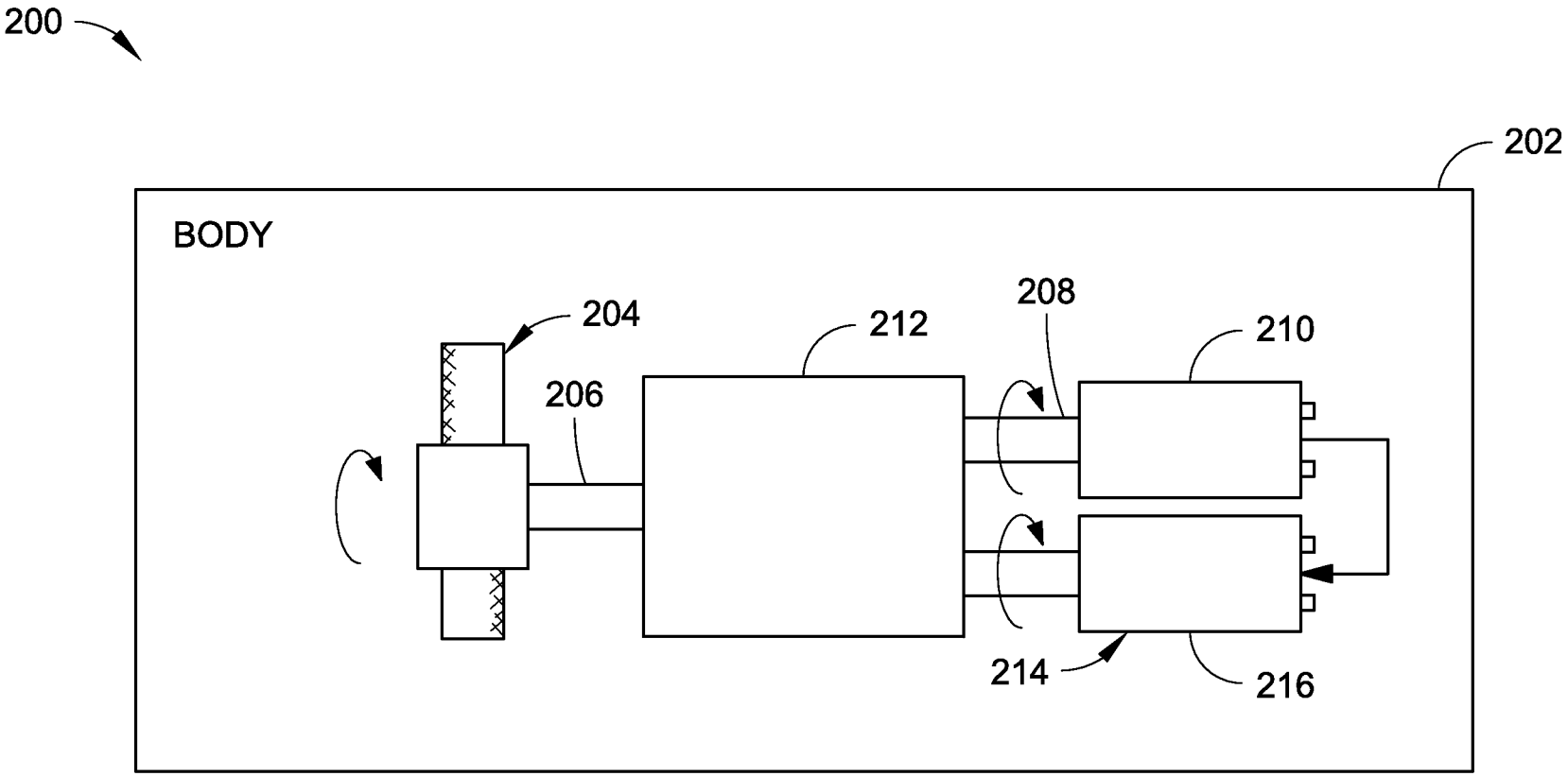
FIG. 4 illustrates various components of an example device that can implement embodiments of a down hole actively controlled power generation mechanism.
Figure 5:
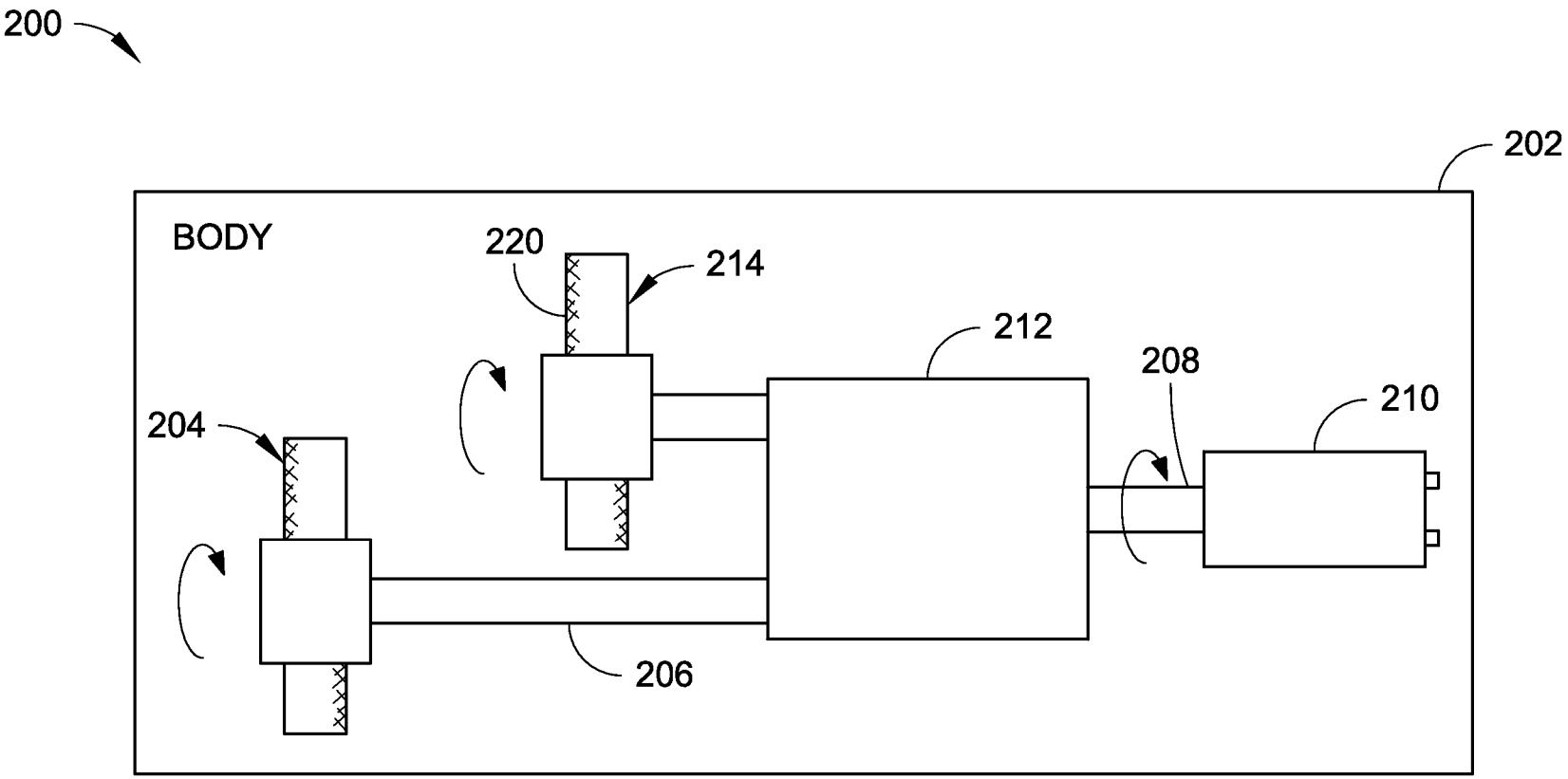
FIG. 5 illustrates various components of an example device that can implement embodiments of a down hole actively controlled power generation mechanism.

Referring now to FIGS. 3 and 4, in some embodiments the drive mechanism 212 can comprise a constant speed drive implemented using a full freedom epicycloids gear train (e.g., where the solar, the planet carrier, and the annulus are each free to rotate), and where two of these components are the inputs (e.g., the mud turbine 204 and the secondary input 214), and the third component is the output (e.g., the alternator 210). For example, the secondary input 214 can be configured as, for instance, a driving motor, such as a speed correction motor 216. In embodiments of the disclosure, the gear ratios between the epicycloids gear train components are calculated using epicycloids equations, and the gear ratios can be set so that the speed correction motor 216 and the alternator 210 can function in their desired operational envelopes.

In these examples, the mud turbine 204 can be designed to begin rotation at a comparatively low fluid flow. At this low fluid flow, the mud turbine 204 can engage the alternator 210 in rotation at the constant speed drive ratio (e.g., where the secondary input 214 is not rotated and may remain fixed). With increasing mud turbine rotation, the speed correction motor 216 may begin to rotate, or can remain fixed (e.g., depending upon whether a simple or complex control system is used to control actuation of the speed correction motor 216). Then, when the alternator 210 reaches a comparatively high angular velocity, the speed correction motor 216 can begin to rotate quickly, resulting in a lowered output rotation and a higher torque to the alternator 210. In this manner, the defined gear ratio between the mud turbine 204, the speed correction motor 216, and the alternator 210 can be maintained in their desired respective ranges.

As shown with reference to FIG. 3, the speed correction motor 216 can be controlled by a closed loop electronic system, which engages its rotation when the impeller rotation begins to generate more than a desired amount of voltage at the output of the alternator 210. This scheme can be implemented using, for example, a comparatively more complex control system scheme (e.g., employing an electronic controller 218). The controller 218 can implement control logic, and can receive and process signals from sensors configured to determine (e.g., sense, measure) one or more operating characteristics (e.g., angular velocity) of the mud turbine 204, the speed correction motor 216, the alternator 210, and so on.

As shown with reference to FIG. 4, the speed correction motor 216 can be implemented using an electric motor that is directly connected (e.g., hard-wired) to the alternator 210. In this example, a power stage can be used to drive the speed correction motor 216, which is directly linked to the output of the alternator 210. For example, the speed correction motor 216 can be implemented using a direct current (DC) motor, an alternating current (AC) induction motor, and so forth. In this manner, the speed correction motor 216 can be configured to begin rotating at any impeller rotation; however, its own actuation can depend upon the output of the alternator 210. In this manner, the drill assembly 200 can achieve equilibrium at a desired voltage output for the alternator 210.

However, it should be noted that the speed correction motor 216 is provided by way of example and is not meant to limit the present disclosure. In other embodiments, the secondary input 214 can be implemented using a mechanical actuator linked to the fluid flow. For example, referring to FIG. 5, an impeller 220 can be used as the secondary input 214 to the drive mechanism 212. In embodiments of the disclosure, the impeller 220 can be configured so that the rotational speeds of both the impeller 220 and the impeller of the mud turbine 204 maintain the output of the constant speed drive implemented by the drive mechanism 212 at least substantially constantly (e.g., at or near a predetermined rotational speed selected for the alternator 210).

Figure 6:
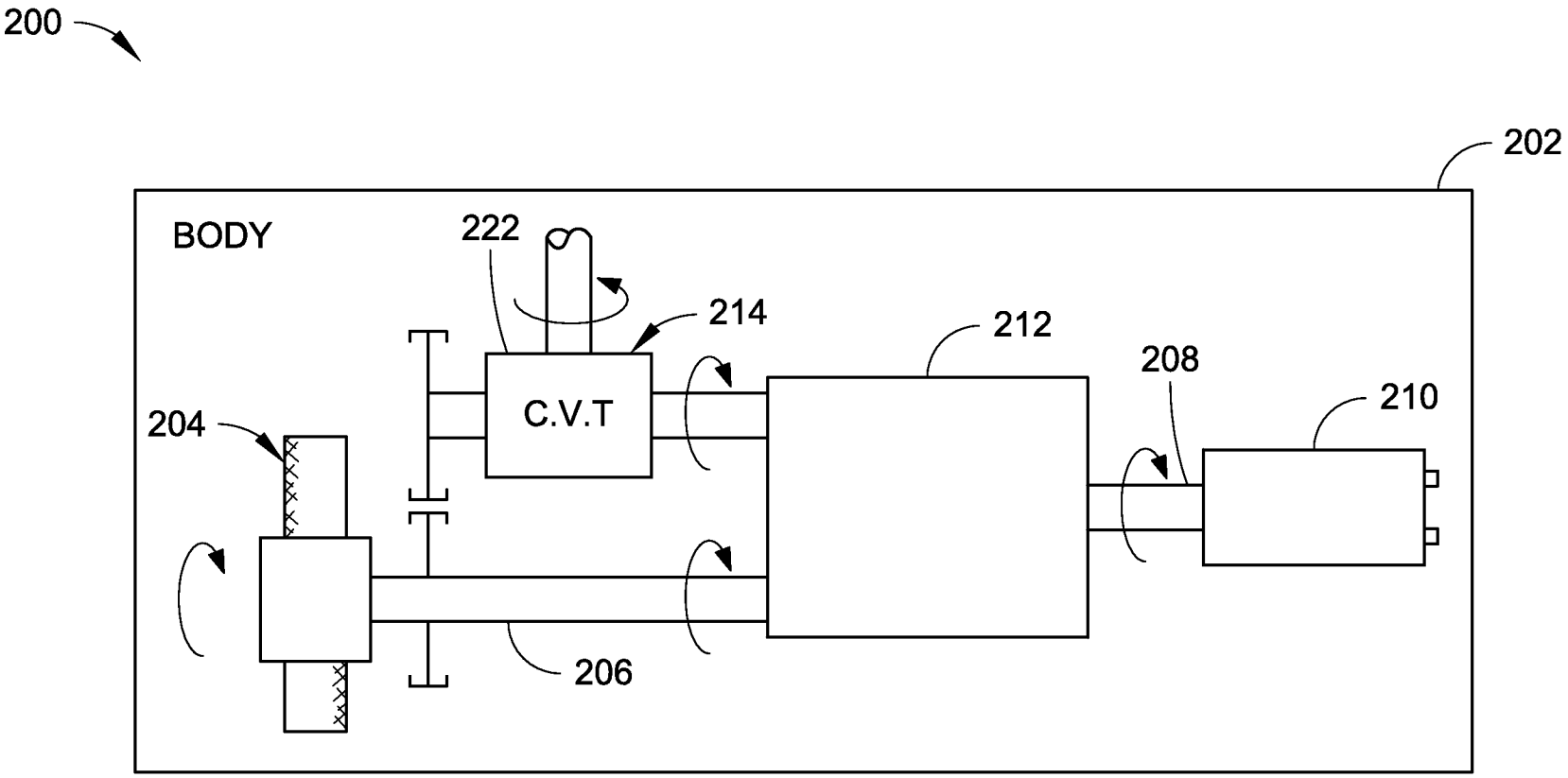
FIG. 6 illustrates various components of an example device that can implement embodiments of a down hole actively controlled power generation mechanism.

Referring now to FIG. 6, the main impeller of the mud turbine 204 can also be used with a transmission 222 (e.g., a continuously variable transmission (CVT)) that provides the secondary input 214 to the drive mechanism 212. For example, the impeller of the mud turbine 204 is the driving input associated with the transmission 222, and the behavior of the transmission 222 can be set mechanically (e.g., using a spring or another biasing mechanism). In this example, the transmission 222 can gradually increase its transmission ratio into the constant state drive of the drive mechanism 212 as the rotation of the impeller increases so that the output rotation can remain within a desired operating range. In other embodiments, the transmission 222 can be driven by a positioning actuator. For example, an electronic control system can be used with a comparatively low power position actuator, which may use a limited control system (e.g., comprising an open loop, a stepper motor, an analog or numeric servo, and so on). However, a limited control system is provided by way of example and is not meant to limit the present disclosure. In other embodiments, the positioning actuator can be controlled by a controller that can implement control logic, and can receive and process signals from sensors configured to determine (e.g., sense, measure) one or more operating characteristics (e.g., angular velocity) of the mud turbine 204, the speed correction motor 216, the alternator 210, and so on.

A system implementing a drill assembly 200, including some or all of its components, can operate under computer control. For example, a processor can be included with or in a system to control the components and functions of systems described herein using software, firmware, hardware (e.g., fixed logic circuitry), manual processing, or a combination thereof. The terms "controller," "functionality," "service," and "logic" as used herein generally represent software, firmware, hardware, or a combination of software, firmware, or hardware in conjunction with controlling the systems. In the case of a software implementation, the module, functionality, or logic represents program code that performs specified tasks when executed on a processor (e.g., central processing unit (CPU) or CPUs). The program code can be stored in one or more computer-readable memory devices (e.g., internal memory and/or one or more tangible media), and so on. The structures, functions, approaches, and techniques described herein can be implemented on a variety of commercial computing platforms having a variety of processors.

The drill assembly 200 can be coupled with a controller (e.g., controller 218) for controlling the output of the drive mechanism 212. The controller can include a processor, a memory, and a communications interface. The processor provides processing functionality for the controller and can include any number of processors, micro-controllers, or other processing systems, and resident or external memory for storing data and other information accessed or generated by the controller. The processor can execute one or more software programs that implement techniques described herein. The processor is not limited by the materials from which it is formed or the processing mechanisms employed therein and, as such, can be implemented via semiconductor (s) and/or transistors (e.g., using electronic integrated circuit (IC) components), and so forth.

The memory is an example of tangible, computer-readable storage medium that provides storage functionality to store various data associated with operation of the controller, such as software programs and/or code segments, or other data to instruct the processor, and possibly other components of the controller, to perform the functionality described herein. Thus, the memory can store data, such as a program of instructions for operating the system (including its components), and so forth. It should be noted that while a single memory is described, a wide variety of types and combinations of memory (e.g., tangible, non-transitory memory) can be employed. The memory can be integral with the processor, can comprise stand-alone memory, or can be a combination of both. The memory can include, but is not necessarily limited to: removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, and so forth.

The communications interface is operatively configured to communicate with components of the system. For example, the communications interface can be configured to transmit data for storage in the system, retrieve data from storage in the system, and so forth. The communications interface is also communicatively coupled with the processor to facilitate data transfer between components of the system and the processor (e.g., for communicating inputs to the processor received from a device communicatively coupled with the controller). It should be noted that while the communications interface is described as a component of a controller, one or more components of the communications interface can be implemented as external components communicatively coupled to the system via a wired and/or wireless connection. The system can also comprise and/or connect to one or more input/output (I/O) devices (e.g., via the communications interface), including, but not necessarily limited to: a display, a mouse, a touchpad, a keyboard, and so on.

The communications interface and/or the processor can be configured to communicate with a variety of different networks, including, but not necessarily limited to: a wide-area cellular telephone network, such as a 3G cellular network, a 4G cellular network, or a global system for mobile communications (GSM) network; a wireless computer communications network, such as a WiFi network (e.g., a wireless local area network (WLAN) operated using IEEE 802.11 network standards); an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example and is not meant to limit the present disclosure. Further, the communications interface can be configured to communicate with a single network or multiple networks across different access points.

Figure 7:
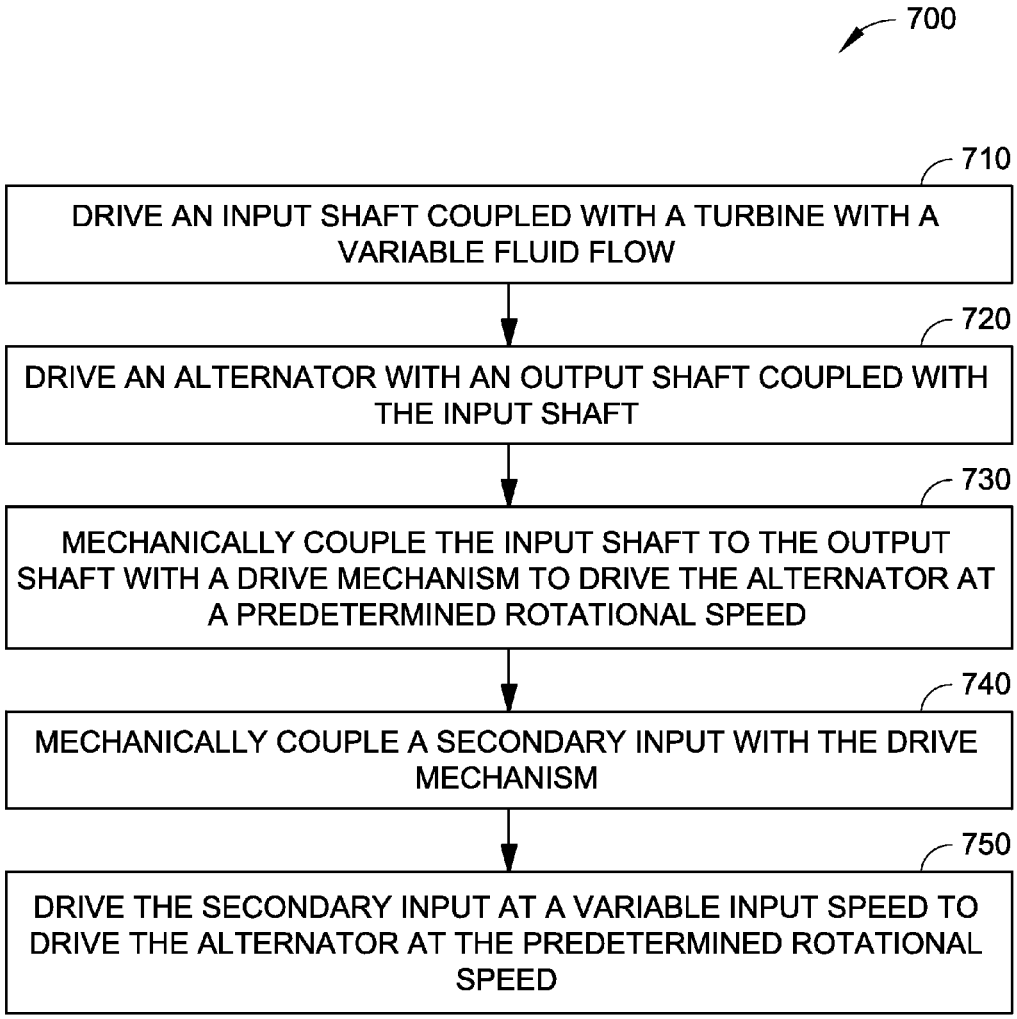
FIG. 7 illustrates example method(s) for actively controlling a down hole power generation mechanism in accordance with one or more embodiments.

Referring now to FIG. 7, a procedure 700 is described in an example embodiment in which a down hole power generation mechanism is actively controlled. At block 710, an input shaft, such as the input shaft 206, coupled with a turbine, such as the mud turbine 204, is driven with a variable fluid flow, such as a variable flow of the drilling fluid 122 or another fluid. At block 720, a generator, such as the alternator 210, is driven with an output shaft, such as the output shaft 208, coupled with the input shaft. At block 730, the input shaft is mechanically coupled to the output shaft with a drive mechanism, such as the drive mechanism 212, to drive the generator at a predetermined rotational speed. At block 740, a secondary input, such as the secondary input 214, is mechanically coupled with the drive mechanism. At block 750, the secondary input is driven at a variable input speed to drive the generator at the predetermined rotational speed.

Although only a few example embodiments have been described in detail above, those skilled in the art will readily appreciate that many modifications are possible in the example embodiments without materially departing from a down hole actively controlled power generation mechanism. Features shown in individual embodiments referred to above may be used together in combinations other than those which have been shown and described specifically. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A down hole drill assembly comprising:

an input shaft coupled with a turbine to be driven by a variable fluid flow;

an output shaft coupled with the input shaft to drive an alternator;

a drive mechanism mechanically coupling the input shaft to the output shaft to drive the alternator at a predetermined rotational speed; and a secondary input mechanically coupled with the drive mechanism, the secondary input to be driven at a variable input speed to drive the alternator at the predetermined rotational speed, wherein the secondary input comprises a speed correction motor or an impeller.

2. The down hole drill assembly as recited in claim 1, wherein the drive mechanism comprises a full freedom epicycloids gear train.

3. A method comprising:

driving an input shaft coupled with a turbine with a variable fluid flow;

driving an alternator with an output shaft coupled with the input shaft;

mechanically coupling the input shaft to the output shaft with a drive mechanism to drive the alternator at a predetermined rotational speed;

mechanically coupling a secondary input with the drive mechanism; and driving the secondary input at a variable input speed to drive the alternator at the predetermined rotational speed, wherein the secondary input comprises a speed correction motor or an impeller.

4. The method as recited in claim 3, wherein the drive mechanism comprises a full freedom epicycloids gear train.

5. A system comprising:

an input shaft to be driven by a variable fluid flow;

an output shaft coupled with the input shaft to drive a generator;

a drive mechanism mechanically coupling the input shaft to the output shaft to drive the generator at a predetermined rotational speed; and a secondary input mechanically coupled with the drive mechanism, the secondary input to be driven at a variable input speed to drive the generator at the predetermined rotational speed, wherein the secondary input comprises a speed correction motor or an impeller.

6. The system as recited in claim 5, wherein the input shaft is coupled with a turbine.

7. The system as recited in claim 5, wherein the variable fluid flow comprises drilling fluid flow.

8. The system as recited in claim 5, wherein the generator comprises an alternator.

9. The system as recited in claim 5, wherein the drive mechanism comprises a full freedom epicycloids gear train.

* * * * *